US009421449B2

(12) United States Patent
Ditto et al.

(10) Patent No.: US 9,421,449 B2
(45) Date of Patent: Aug. 23, 2016

(54) PERFORMANCE ENHANCING GLOVE

(71) Applicants: Dane E. Ditto, Wamego, KS (US); Campbell E. Ditto, Wamego, KS (US)

(72) Inventors: Dane E. Ditto, Wamego, KS (US); Campbell E. Ditto, Wamego, KS (US)

( * ) Notice: Subject to any disclaimer, the term of this patent is extended or adjusted under 35 U.S.C. 154(b) by 0 days.

(21) Appl. No.: 14/481,048

(22) Filed: Sep. 9, 2014

(65) Prior Publication Data

US 2015/0067946 A1 Mar. 12, 2015

Related U.S. Application Data

(60) Provisional application No. 61/875,297, filed on Sep. 9, 2013.

(51) Int. Cl.
*A63B 71/14* (2006.01)
*A41D 19/015* (2006.01)

(52) U.S. Cl.
CPC ..... *A63B 71/146* (2013.01); *A41D 19/01547* (2013.01); *A63B 71/141* (2013.01); *A63B 71/143* (2013.01)

(58) Field of Classification Search
CPC .. A63B 71/141; A63B 71/143; A63B 71/146; A63B 69/0046; A63B 69/0048; A63B 71/14; A63B 71/148; A41D 13/08; A41D 13/081; A41D 13/082; A41D 19/01547
USPC ..... 2/19, 161.1, 161.2, 161.3, 20, 161.6, 2/16; 473/205; 294/25
See application file for complete search history.

(56) References Cited

U.S. PATENT DOCUMENTS

| | | | | |
|---|---|---|---|---|
| 4,546,495 | A * | 10/1985 | Castillo | 2/161.1 |
| 4,691,387 | A | 9/1987 | Lopez | |
| 6,721,960 | B1 | 4/2004 | Levesque et al. | |
| D629,570 | S | 12/2010 | Kanemitsu et al. | |
| 7,895,669 | B2 | 3/2011 | Kleinert | |
| 8,256,028 | B1 | 9/2012 | Ibon et al. | |
| 2011/0099687 | A1* | 5/2011 | Skrocki | 2/161.1 |
| 2012/0316485 | A1* | 12/2012 | Fryda et al. | 602/21 |

FOREIGN PATENT DOCUMENTS

| | | |
|---|---|---|
| EP | 0293526 | 12/1988 |

* cited by examiner

*Primary Examiner* — Clinton T Ostrup
*Assistant Examiner* — Abby Spatz
(74) *Attorney, Agent, or Firm* — Law Office of Mark Brown, LLC; Christopher M. DeBacker; Mark E. Brown

(57) ABSTRACT

A performance enhancing glove for use with sports tools, such as baseball and softball bats, golf clubs, and tennis racquets. The present invention includes a tapered pad located on the palm of the glove which, when gripping a sport tool, forms a cone-like feature around the tool, increasing grip and swing speed of the tool by correcting the grip of the athlete. The taper starts at its maximum thickness just under the fifth metacarpal-phalangeal (MCP) joint and ends at a minimal thickness just under the second MCP joint. The pad is also tapered from the palm starting at the distal palmar crease, with maximum thickness and tapering to minimum thickness at the top of the MCP joints. A second pad runs along the side of the glove against the pinky and acts to separate the athlete's hands when both hands grip the tool.

6 Claims, 7 Drawing Sheets

PERFORMANCE ENHANCING GLOVE

CROSS-REFERENCE TO RELATED APPLICATION

This application claims priority in U.S. Provisional Patent Application No. 61/875,297, filed Sep. 9, 2013, which is incorporated herein by reference.

BACKGROUND OF THE INVENTION

1. Field of the Invention

The present invention relates generally to a performance enhancing glove, and in particular to a glove for improving the efficiency of athletes engaged in batting and other sports such as golf, tennis, racquetball, hockey, etc. using hand-held equipment.

2. Background and Description of the Related Art

Gloves are extensively used in various activities, such as sports, manual work and other physical activities. Specifically, gloves are used in various sports for enhancing performance when gripping sports tools, such as baseball bats or tennis rackets.

Baseball gloves, for example, typically employ padding to protect the player's hand from errant pitches, bad swings, or other injuries. These gloves also employ typical elements such as gripping surfaces for increasing the grip on the bat, as well as padding intended to increase comfort while swinging. However, existing gloves fail to increase performance, such as swing velocity, in any meaningful way.

Heretofore there has not been available a performance enhancing glove with the advantages and features of the present invention.

SUMMARY OF THE INVENTION

The present invention provides a performance enhancing glove with varying-thickness padding. The result is improved contact with the sporting tool, such as a baseball bat, resulting in increased swing velocity of the tool.

A performance enhancing glove has a tapered pad located across the palm, specifically across the second through fifth metacarpal-phalangeal (MCP) joints of the hand. The pad is thinnest at the first palmar crease below the second MCP joint, and is the thickest below the fifth MCP joint. This creates a cone effect when a baseball bat or other sporting tool is gripped in the hand. The cone effect increases the effective grip on the bat or other tool, and results in increased control over the tool and increased swing speed, thereby resulting in increased velocity of the ball speed when struck by the tool.

A second pad is located along the side of the hand next to the fifth MCP joint, and terminates near the wrist. This pad provides separation between the hands when both hands are gripping the tool, increasing control.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning.

II. Preferred Embodiment Performance Enhancing Glove 2

Figure 1:
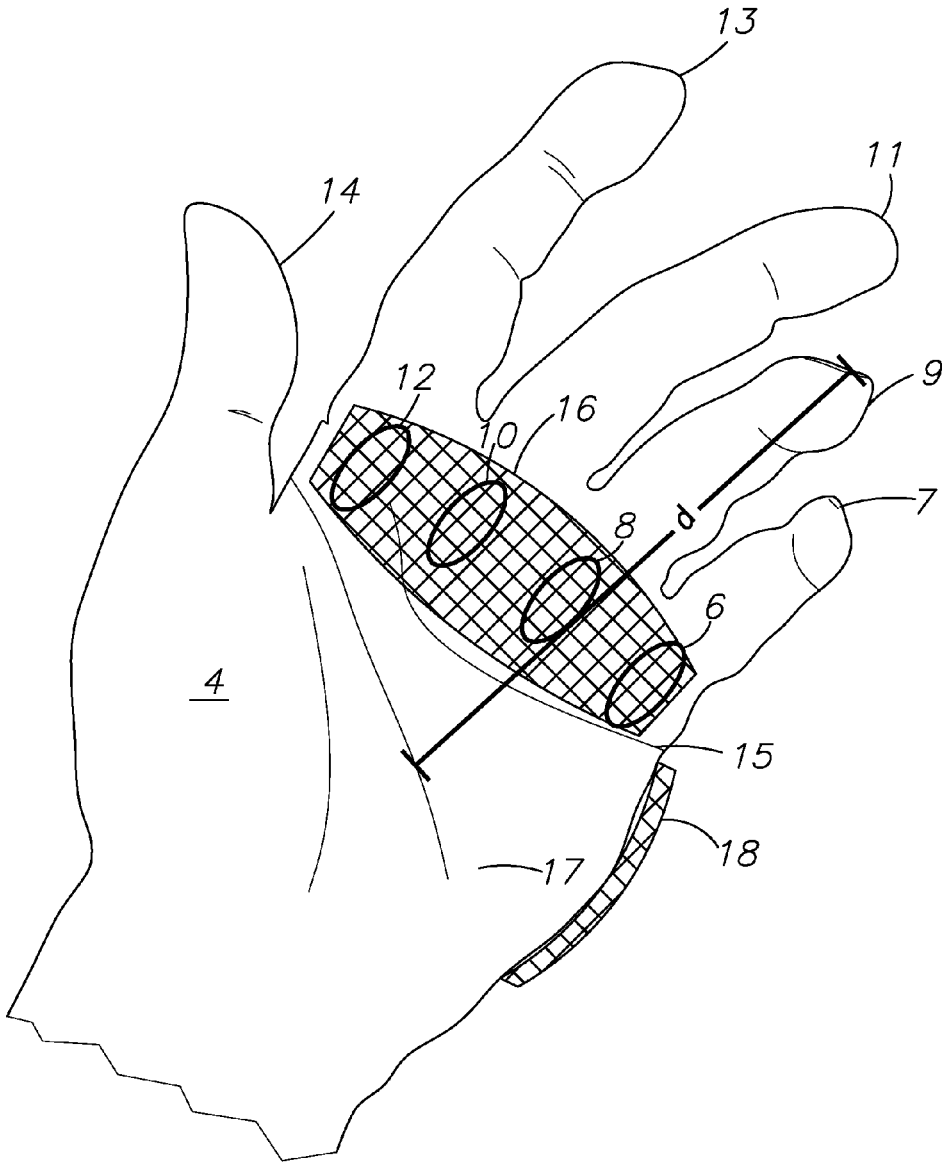
FIG. 1 is a front elevational view of a human hand, indicating the areas of intended focus for an embodiment of the present invention.

Referring to the figures in more detail, FIG. 1 shows a typical human hand 4 including a thumb 14, index finger 13, middle finger 11, ring finger 9, and pinky finger 7. A target area 16 is indicated overlaying the second through fifth metacarpal-phalangeal (MCP) joints 12, 10, 8, 6. These joints are covered with padding of varying thicknesses in a preferred embodiment of the present invention. A second side target area 18 is also indicated, which will be provided with a side pad for maintaining spacing between hands when a preferred embodiment of the present invention is in use.

Figure 2:
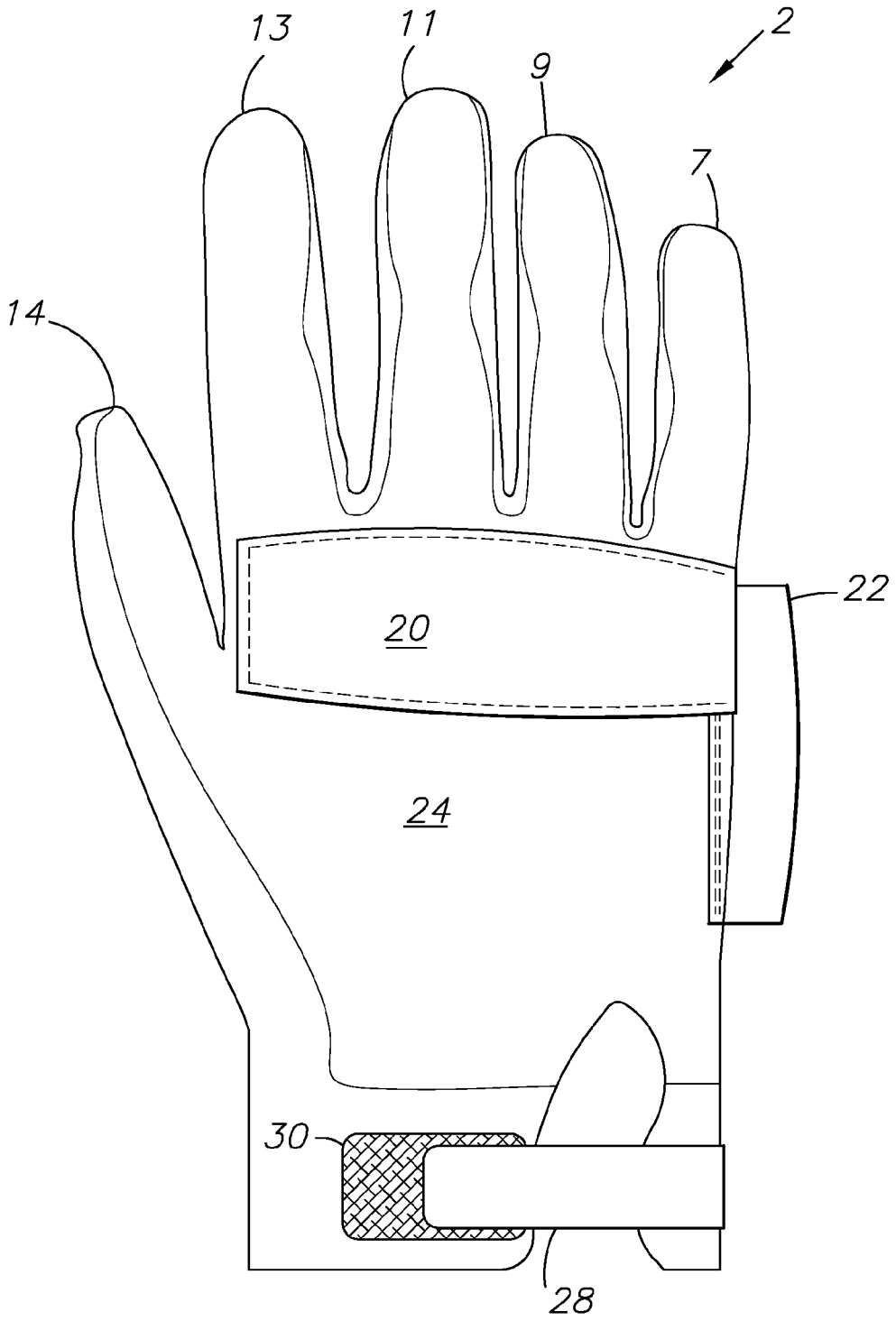
FIG. 2 is a front elevational view of a performance enhancing glove comprising a preferred embodiment of the present invention.

FIG. 2 shows a preferred embodiment of the present invention performance enhancing glove 2. FIG. 2 displays a right-handed glove, but a preferred embodiment would include a separate glove for each hand, wherein the two gloves will mirror image each other. The glove contains a thumb 14, index 13, middle 11, ring 9, and pinky 7 receiver. A preferred embodiment will include a high-friction gripping surface 24 overlaying the palm and the insides of the fingers, as shown. An optional adjustable strap 28 and hook and loop receiver 30 may be included to secure the glove 2 around the wrist.

Figure 3:
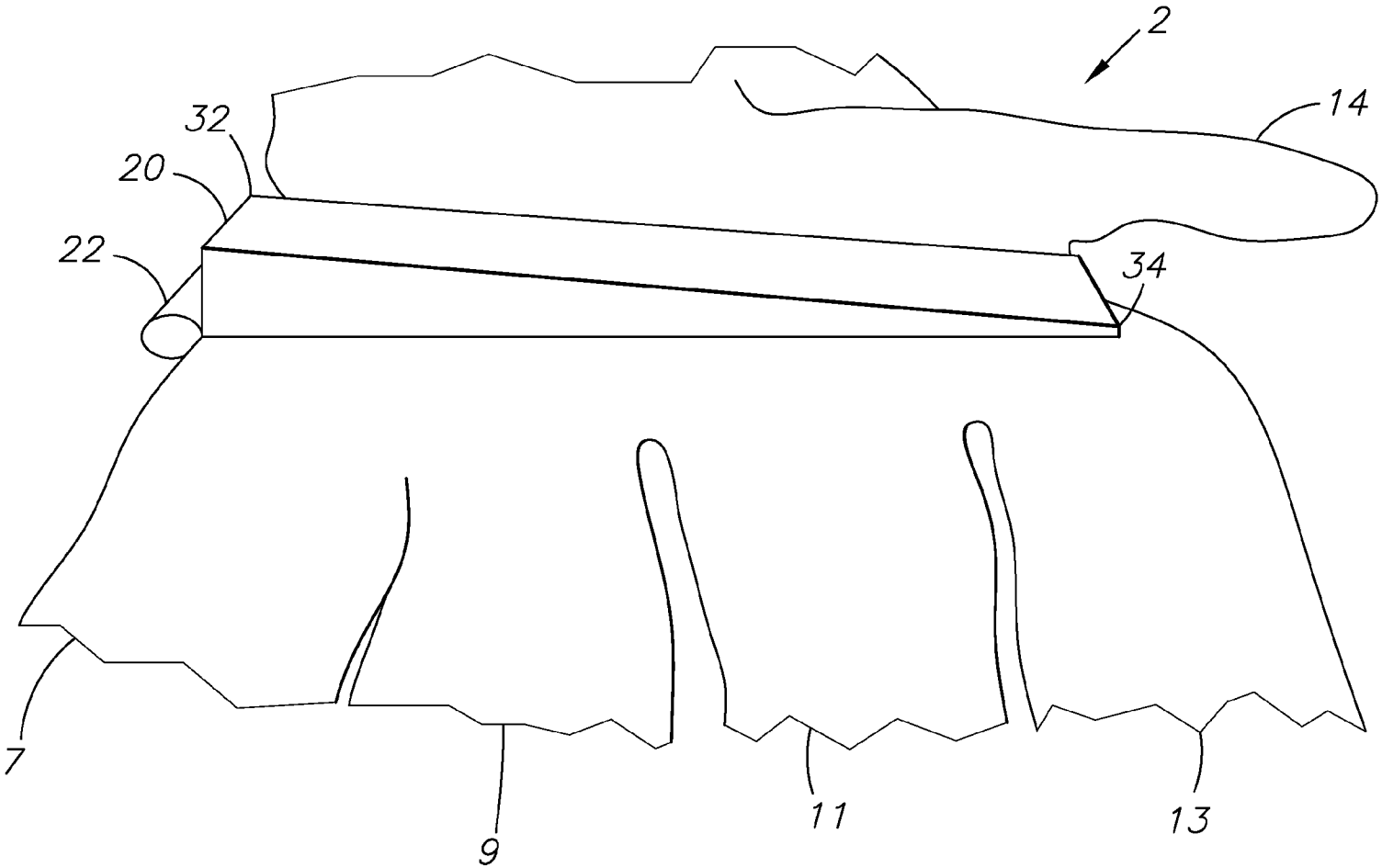
FIG. 3 is a top plan view thereof.
Figure 3A:
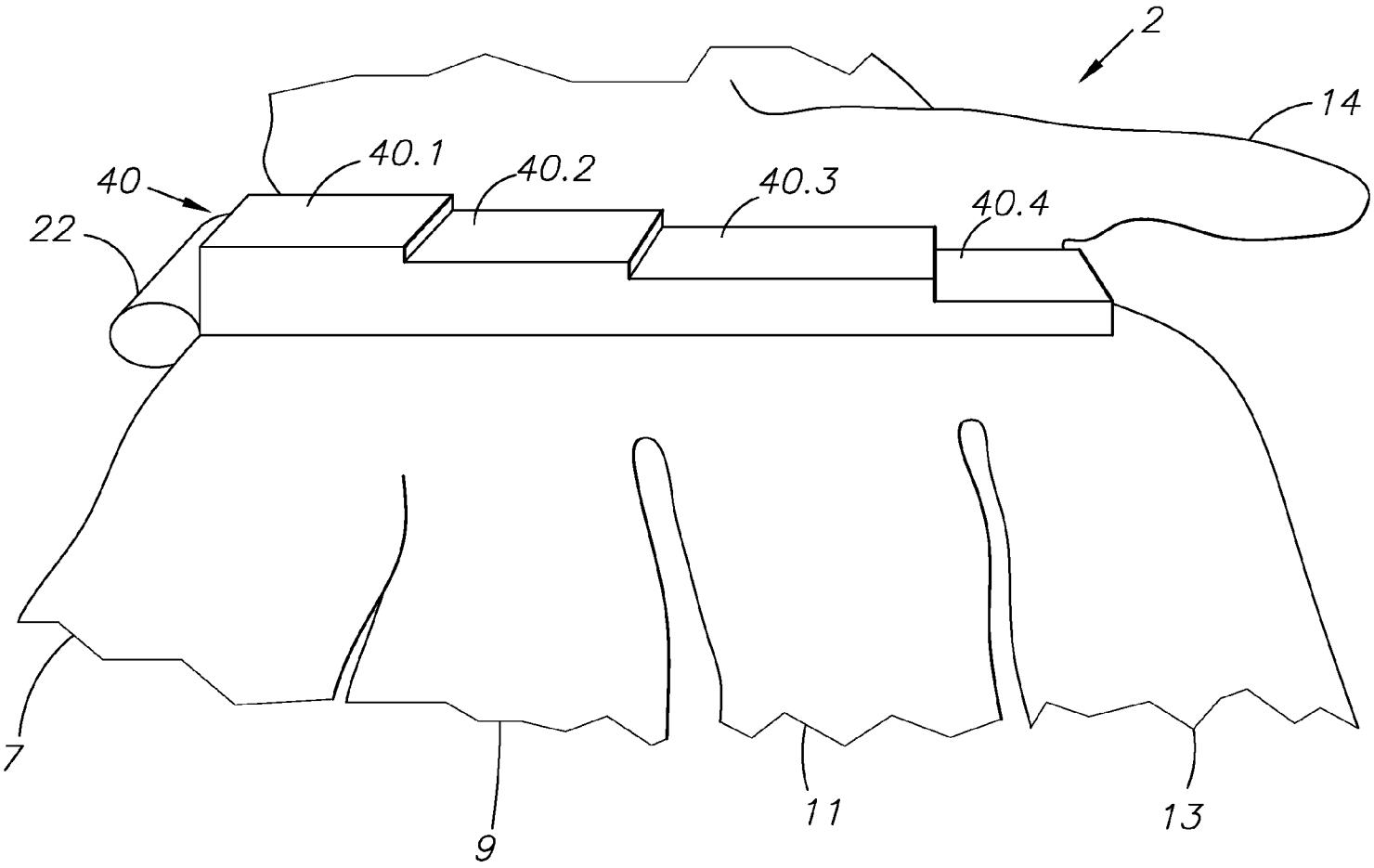
FIG. 3A is a top plan view thereof, showing an alternative arrangement of a padding element of the embodiment.

A primary pad 20 is placed over the palm portion of the hand. The pad 20 starts at its maximum thickness just under the fifth MCP joint 6 and tapering down to a minimal thickness just under the second MCP joint 12. This is shown in more detail in FIG. 3. The pad is also tapered from the palm starting at the first palmar crease 15, also called the distal palmar crease, with maximum thickness and tapering to minimum thickness at the top of the MCP joints. The max thickness point 32 and minimum thickness point 34 are indicated on FIG. 3. FIG. 3A shows a tiered pad 40 instead of the gently sloping pad 20 shown in FIG. 3. This alternative arrangement features a specific thickness 40.1, 40.2, 40.3, and 40.4. at each level for each respective MCP joint. The results are similar.

Figure 4:
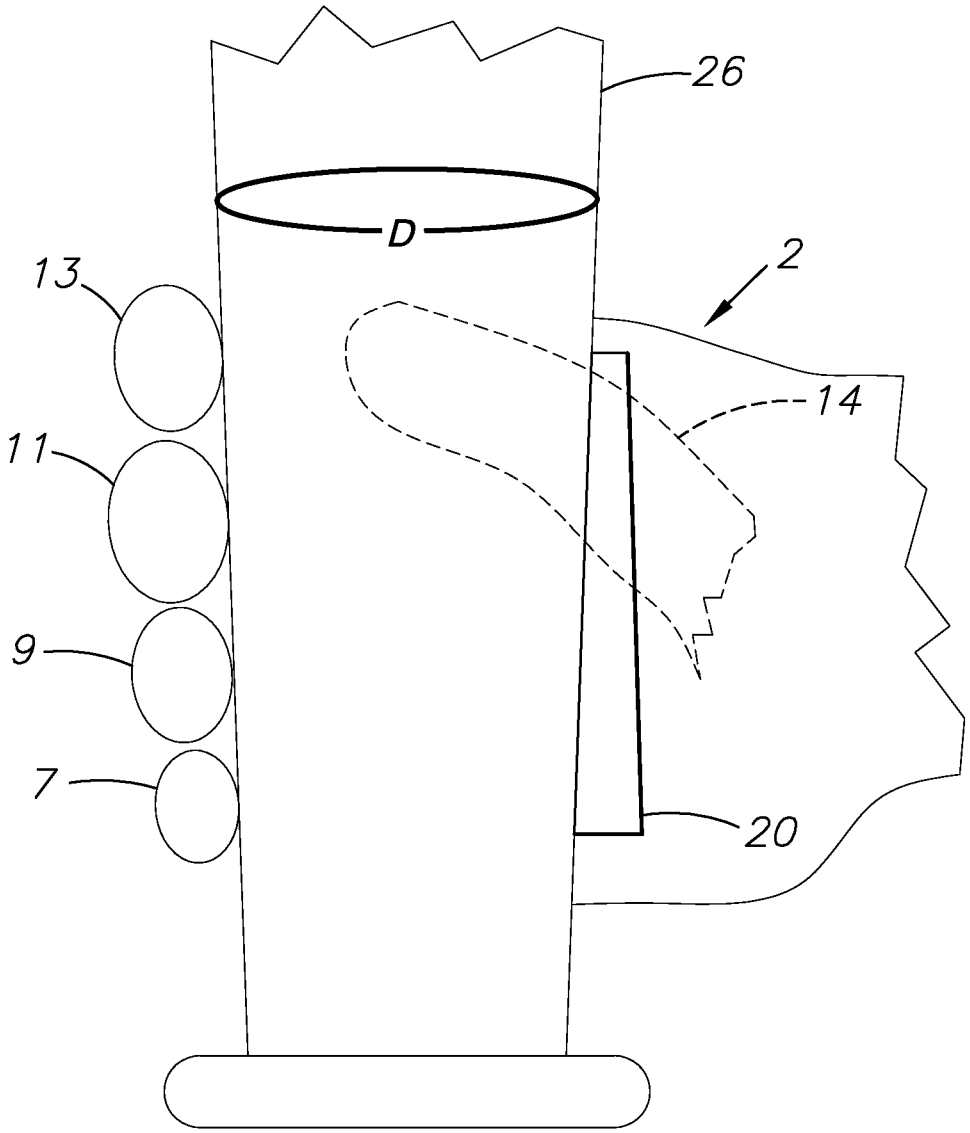
FIG. 4 is a front elevational view of an embodiment of the present invention in a typical environment.
Figure 5:
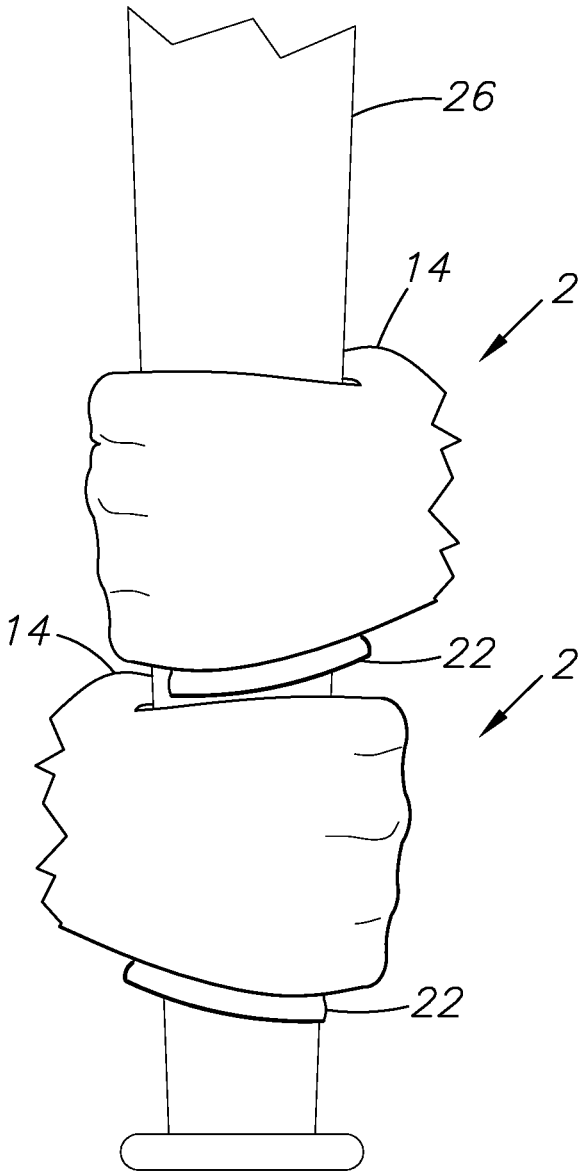
FIG. 5 is a rear elevational view thereof.
Figure 6:
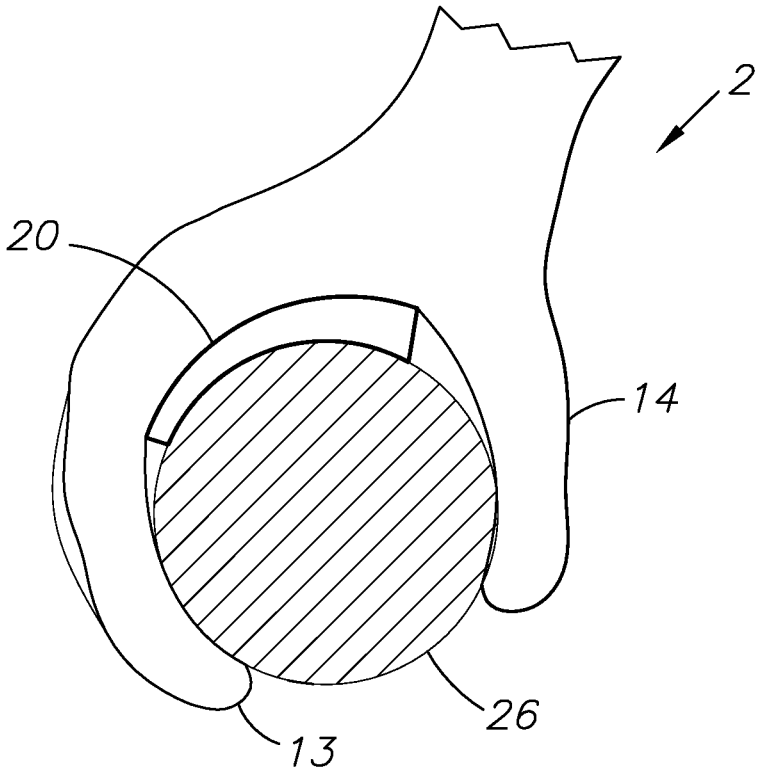
FIG. 6 is a top plan view thereof.

This tapering creates a tapered cone effect when the hand grips a handle of a sports tool, such as a baseball bat 26, demonstrated in FIGS. 4-6. The ideal thickness measurement is calculated by taking the measurement of the athlete's dominant hand starting at the tip of the 4th finger down to the second palmar crease 17, also called the proximal palmar crease, illustrated by the distance d in FIG. 3. The diameter D of the club, racquet, or bat is then subtracted from the distance d, into a resultant value R. The R value is then divided by 2, for a final measurement m. This final value is the maximum thickness of the pad 20 at the point of maximum thickness 32. The pad 20 is extended to the side of the glove and down to the wrist, resulting in the side pad portion 22. This pad is ideally 3 mm in thickness greater than the maximum thickness m calculated above. This second pad 22 provides spacing between two hands when both hands are gripping a bat, racquet, or club as shown in FIG. 5.

The pad 20 promotes proper technique in gripping the handle of a sporting tool, such as a club, a racquet, or a bat. It forces the user to maintain the handle within the region of the fingers, provides mild separation from the handle, and thereby increase swing velocity due to increased negative couple force by the third, fourth, and fifth fingers (middle, ring, and pinky). All of these factors result in improved control and results out of the sporting tool.

When tested, the results of the present invention create an improved bat swing velocity no matter the athlete's performance and athleticism. An increase of bat velocity results in a 1:1 increase of the batted ball speed when the ball is struck by the bat. Typical thickness may be as little as 3 mm at the thinnest portion and as little as 7 mm or more at the fifth MCP joint, thereby creating the cone effect discussed above.

A preferred embodiment includes at least a right handed glove or a left handed glove, but could include both gloves together, as shown in FIG. 5.

It is to be understood that while certain aspects of the disclosed subject matter have been shown and described, the disclosed subject matter is not limited thereto and encompasses various other embodiments and aspects.

Having thus described the invention, what is claimed as new and desired to be secured by Letters Patent is:

1. A glove for gripping a sports device handle, said glove comprising:

a palm portion, a thumb portion, and four finger portions;

a pad located over an area of said palm portion configured to cover the second through fifth metacarpal-phalangeal (MCP) joints of a hand;

said pad comprising four tiers, including a first tier corresponding with a first of said four finger portions, a second tier corresponding with a second of said four finger portions, a third tier corresponding with a third of said four finger portions, and a fourth tier corresponding with a fourth of said four finger portions, wherein said fourth tier is thicker than said third tier, said third tier is thicker than said second tier, and said second tier is thicker than said first tier;

said pad including a taper from an area in proximity with a bottom edge of said palm portion to an area in proximity with a top edge of said palm portion;

whereby said four tiers and said taper generate a maximum thickness and a minimum thickness of said tapered pad, wherein said maximum thickness is located in proximity to said area comprising a location where said fourth finger portion joins said palm portion at said bottom edge, and said minimum thickness is located in proximity to said area comprising a location where said first finger portion joins said palm portion at said top edge; and said minimum thickness being at least one millimeter less than said maximum thickness.

2. The glove according to claim 1, wherein said pad is configured to create a cone shape when gripped about the handle of a sporting instrument.

3. The glove according to claim 2, wherein said sporting instrument is selected from the group consisting of: a baseball bat, a softball bat, a racquet, and a golf club.

4. The glove according to claim 1, further comprising:

a spacing pad affixed to said glove along a side in proximity with said fourth finger portion;

said spacing pad having a thickness greater than the maximum thickness of said tapered pad; and wherein said spacing pad is configured to be placed adjacent to a second gloved hand.

5. The glove according to claim 4, wherein the thickness of said spacing pad is 3 millimeters greater than said maximum thickness of said tapered pad.

6. The glove according to claim 1, further comprising:

a wrist opening; and an adjustable wrist strap for securing said wrist opening.

* * * * *